US006991566B1

(12) United States Patent
McKinney, Sr.

(10) Patent No.: US 6,991,566 B1
(45) Date of Patent: Jan. 31, 2006

(54) PORTABLE SPORTS ASSEMBLY

(76) Inventor: Arnold McKinney, Sr., 16820 Mark Twain, Detroit, MI (US) 48235

( * ) Notice: Subject to any disclaimer, the term of this patent is extended or adjusted under 35 U.S.C. 154(b) by 64 days.

(21) Appl. No.: 10/719,922

(22) Filed: Nov. 21, 2003

(51) Int. Cl.
*A63B 69/00* (2006.01)

(52) U.S. Cl. ..... 473/459

(58) Field of Classification Search ..... 473/422, 473/459, 462, 465, 473, 474, 434, 435, 431; 160/113, 130, DIG. 8, 135
See application file for complete search history.

(56) References Cited

U.S. PATENT DOCUMENTS 2,587,698 A * 3/1952 Corn, Jr. et al. ..... 160/135
3,563,544 A * 2/1971 Hendrick ..... 473/435
4,852,889 A * 8/1989 Tomczak ..... 473/473
4,974,843 A * 12/1990 Henningsson ..... 473/431
5,054,507 A * 10/1991 Sparks ..... 135/97
5,778,959 A * 7/1998 Guetschow ..... 160/231.2
5,934,679 A * 8/1999 Strain et al. ..... 273/395
6,357,750 B1 * 3/2002 Lievens ..... 273/395

* cited by examiner

*Primary Examiner*—Raleigh W. Chiu
(74) *Attorney, Agent, or Firm*—Law Offices of John Chupa & Associates, P.C.

(57) ABSTRACT

A portable sports assembly (10) having a left side ricochet panel (12), a left side strike panel (16) which is pivotally coupled to the left side ricochet panel (12), a center panel (20) which is pivotally coupled to both the left side strike panel (16) and a right side strike panel (18), and a right side ricochet panel (14) which is pivotally coupled to the right side strike panel (18). Particularly, each respective panel (12, 14, 16, 18, 20) may be selectively adjusted to provide a desired angle between each respective panel (12, 14, 16, 18, 20), effective to allow a user top propel a ball at the assembly (10), strike the assembly (10) with the ball, and have the ball ricochet back to the user.

1 Claim, 4 Drawing Sheets

PORTABLE SPORTS ASSEMBLY

FIELD OF THE INVENTION

The present invention generally relates to a portable sports assembly and, more particularly, a portable sports assembly having a plurality of interconnected and movable panels which allow an individual to selectively adjust the angles of the selectively movable panels, such that a propelled ball which contacts one of the plurality of movable panels will ricochet in a direction which is substantially near the point at which the ball was propelled.

BACKGROUND OF THE INVENTION

There are pluralities of known sports which require the use of a specially designed field or court to play or practice the sports. For example and without limitation, the sport of tennis requires the use of a tennis court having several boundary lines and a net. Oftentimes, individuals that desire to play or practice the sport of tennis are unable to play or practice because a tennis court may not be available, near, or exist in the general location of the individuals.

Previous methods for attempting to play or practice a sport without the use of a specifically designed field or court include, but are not limited to: improvising or creating a field or court in a location which is accessible; taking one or two aspects of the sport that an individual desires to play or practice and finding a location which will permit the individual to play or practice the desired sport; and purchasing a specific piece of sports equipment which is designed to allow an individual to practice at least one aspect of a desired sport. Although each of the aforementioned methodologies do desirably allow an individual to play or practice a desired sport, they all suffer from some drawbacks.

For example and without limitation, improvising or creating a field or court in a location which is accessible requires the individual to undesirably alter the appearance of the accessible location in order to play or practice the desired sport. That is, if an individual desires to play or practice the sport of tennis, the individual must first locate a substantially level playing surface, measure out a traditional tennis court, mark the boundary lines, fabricate or locate an object which can be utilized in the place of a conventional tennis net, and set up the fabricated or located object. The steps of this previous methodology are substantially time consuming, thereby leaving the individual less time to play or practice the desired sport of tennis. Moreover, the individual may not be permitted or able to leave the "make-shift" tennis court in the location upon which the individual improvised or created the tennis court. The individual then must disassemble the created tennis court, thereby further consuming more of the individual's time to play or practice the desired sport of tennis.

In further example and without limitation, taking one or two aspects of the sport that an individual desires to play or practice and finding a location which will permit the individual to play or practice the desired sport undesirably requires the individual to sacrifice practicing several aspects of the desired sport. That is, if the individual desires to play or practice the sport of tennis, the individual must choose aspects of the sport which do not require interaction with another player, and which do not require the boundary lines or the net of a conventional tennis court. One well known example of this methodology involves an individual hitting a tennis ball against a substantially flat surface, such as a wall. In this well known example, the individual has sacrificed the ability to practice serving the tennis ball (i.e., there is no net to realistically aim the tennis ball over and there is no boundary line or service court for the individual to aim the tennis ball within), the ability to hit cross court shots, overhead shots, or volley shots, or the unpredictable direction of a tennis ball which has been returned by an opponent (i.e., it is well known in physics that the angle of inclination is equal to the angle of declination and, as such, the individual inherently knows or can approximate the rebound or ricochet of a struck tennis ball at a wall).

In further example and without limitation, purchasing a specific piece of sports equipment which is designed to allow an individual to practice at least one aspect of a desired sport. undesirably suffers from substantially similar drawbacks as the previously discussed methodology. That is, a piece of equipment, such as and without limitation, a tennis ball propelling machine does desirably allow an individual to practice forehand shots, backhand shots, volleys, and the like, however, it does not allow an individual to practice serving a tennis ball. Moreover, a lack of a traditional tennis court further requires the individual to either find a location having a suitable surface as well as a barrier to hit the tennis ball into or requires the individual to undesirably "chase" and gather each struck tennis ball.

There is therefore a need for a sports assembly which allows an individual to practice substantially all aspects of a desired sport. There is also a need for a sports assembly which is portable and may be set up in substantially any desired location, and which overcomes some or all of the previously delineated drawbacks of prior sports practicing/playing methodologies. There is still a further need for a method which allows an individual to play/practice substantially any desired sport in a manner which overcomes some or all of the previously delineated drawbacks of prior sports practicing/playing methodologies.

SUMMARY OF THE INVENTION

A first non-limiting advantage of the present invention is that it provides a portable sports assembly which allows for the selective ricocheting of a ball in a manner which overcomes the previously delineated drawbacks of prior sports assemblies.

A second non-limiting advantage of the invention is that it provides a portable sports assembly which overcomes the previously delineated drawbacks of prior sports assemblies, and which by way of example and without limitation, provides a plurality of selectively adjustable panels which may be pivotally positioned in a manner which allows a user to utilize the assembly or a manner which allows a user to compact the assembly into a portable position.

A third non-limiting advantage of the present invention is that it provides a method for using a portable sports assembly.

A fourth non-limiting advantage of the present invention is that it provides a portable sports assembly. Particularly, the portable sports assembly comprises a left side ricochet panel having a first width, a first profile edge, and a second profile edge; a right side ricochet panel having a second width, a third profile edge, and a fourth profile edge; a left side strike panel having a third width, a fifth profile edge, and a sixth profile edge; a right side strike panel having a fourth width, a seventh profile edge, and an eighth profile edge; and a center panel having a fifth width, a ninth profile edge, and a tenth profile edge, wherein the second profile edge of the left side ricochet panel is pivotally coupled to the third profile edge of the left side strike panel, wherein the fourth profile edge of the left side strike panel is pivotally coupled to the ninth profile edge of the center panel, wherein the tenth profile edge of the center panel is pivotally coupled to the fifth profile edge of the right side strike panel, and wherein the sixth profile edge of the right side strike panel is pivotally coupled to the seventh profile edge of the right side ricochet panel.

A fifth non-limiting advantage of the present invention is that it provides a portable sports assembly. Particularly, the portable sports assembly comprises a plurality of generally rectangular panels each having a respective height and a respective width, wherein each of the plurality of panels are movably coupled to at least one respective panel of the plurality of panels; at least one selectively movable net portion which is movably coupled to at least one of the plurality of panels; and at least one wheel assembly which is coupled to only one of the plurality of panels, wherein each of the panels have at least a two hundred and seventy degree range of motion to the at least one panel to which the panel is movably coupled.

A sixth non-limiting advantage of the present invention is that it provides a method for using a portable sports assembly. Particularly, the method comprises the steps of providing a left side ricochet panel having a first width, a first profile edge, and a second profile edge; providing a right side ricochet panel having a second width, a third profile edge, and a fourth profile edge; providing a left side strike panel having a third width, a fifth profile edge, and a sixth profile edge; providing a right side strike panel having a fourth width, a seventh profile edge, and an eighth profile edge; providing a center panel having a fifth width, a ninth profile edge, and a tenth profile edge; pivotally coupling the second profile edge of the left side ricochet panel to the third profile edge of the left side strike panel; pivotally coupling the fourth profile edge of the left side strike panel to the ninth profile edge of the center panel; pivotally coupling the tenth profile edge of the center panel to the fifth profile edge of the right side strike panel; pivotally coupling the sixth profile edge of the right side strike panel to the seventh profile edge of the right side ricochet panel; providing a measurement chart having predetermined measurements of length and angles; selectively adjusting an angle between each of the panels according to the predetermined measurements of the provided measurement chart; and propelling a ball at the respective panels, effective to cause the ball to strike the respective panels and ricochet back to an individual.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Figure 1:
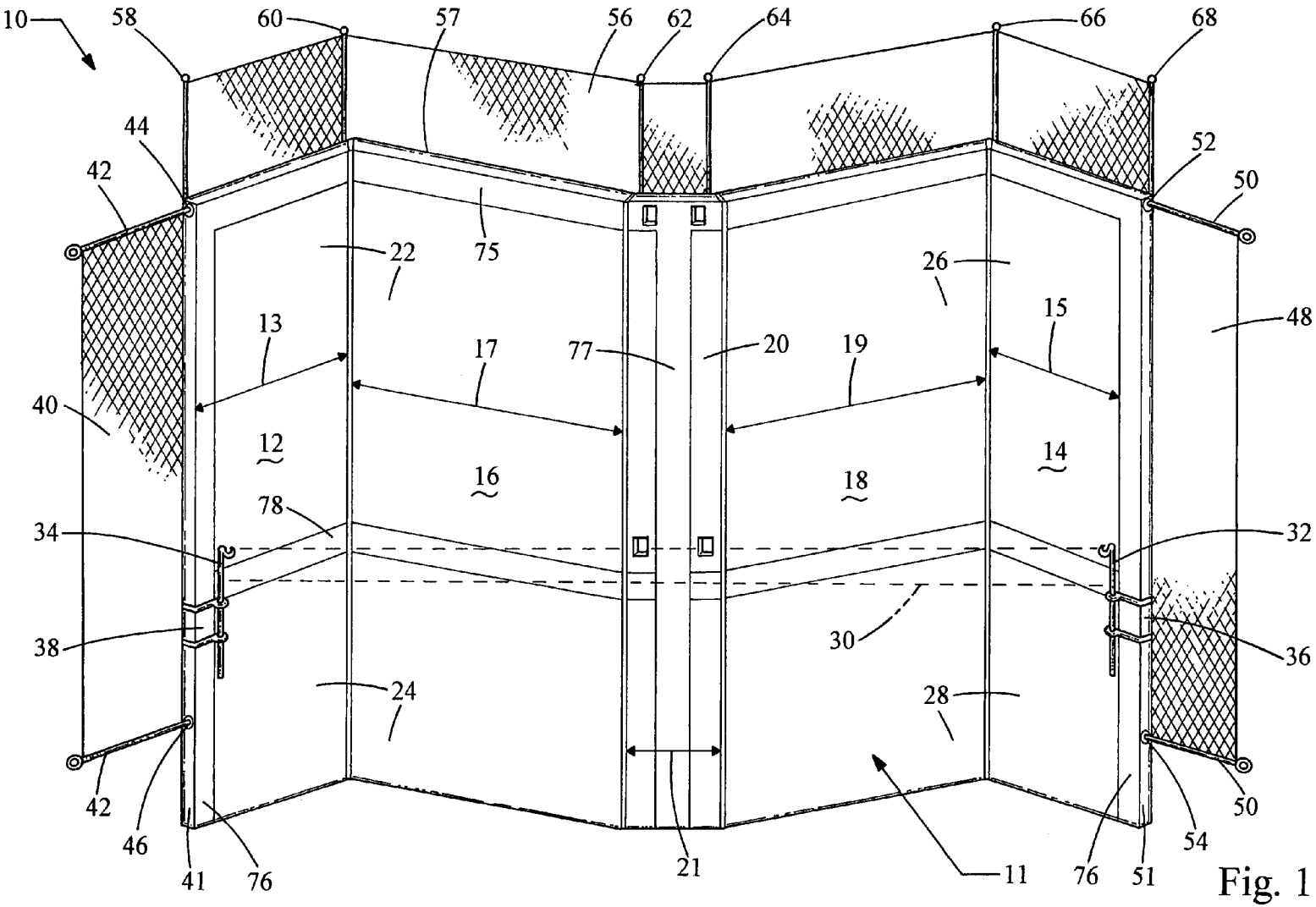
FIG. 1 is a front side perspective view of a portable sports assembly which is made in accordance with the teachings of the preferred embodiment of the invention.
Figure 2:
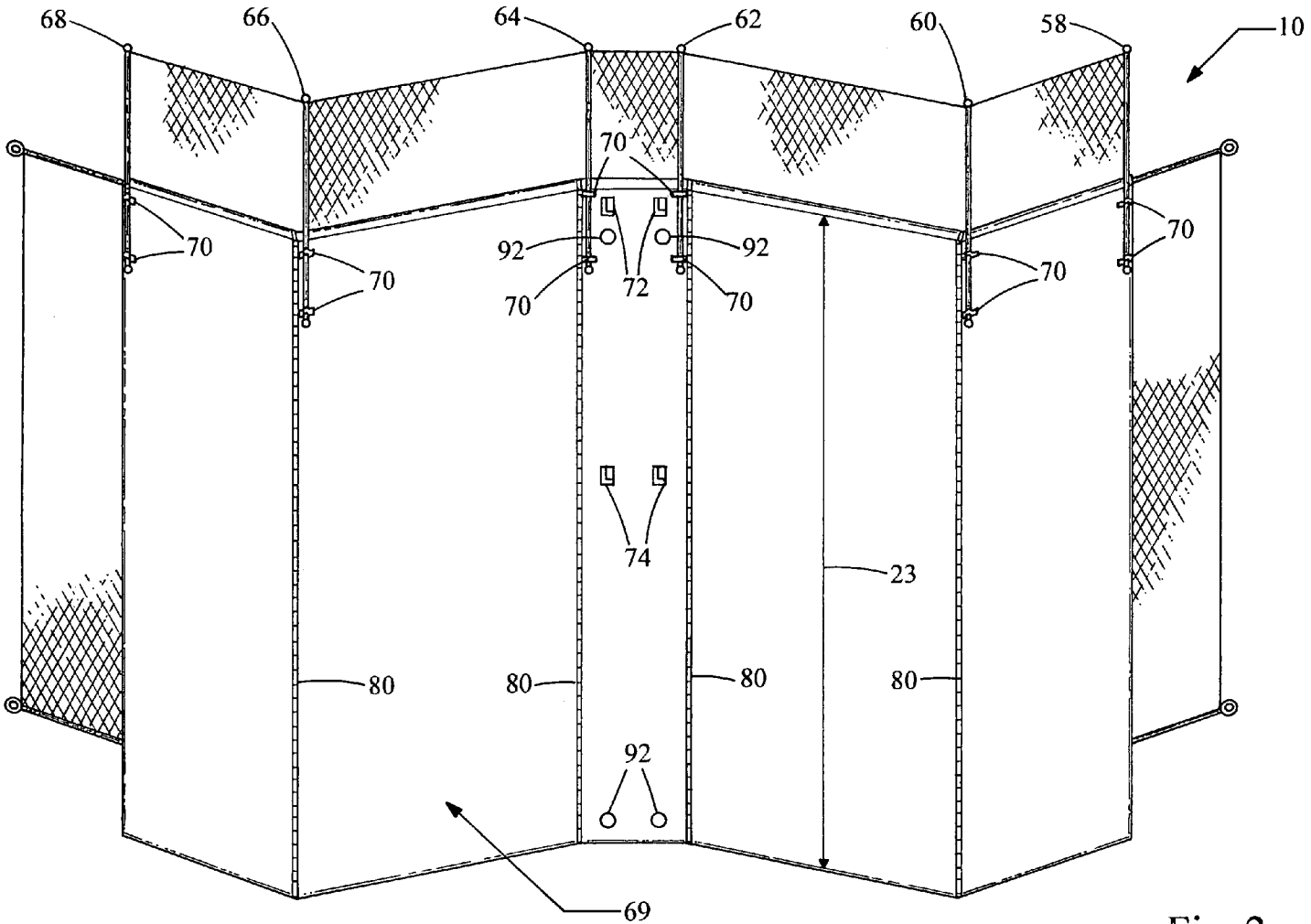
FIG. 2 is a back side perspective view of the portable sports assembly which is shown in FIG. 1.
Figure 3:
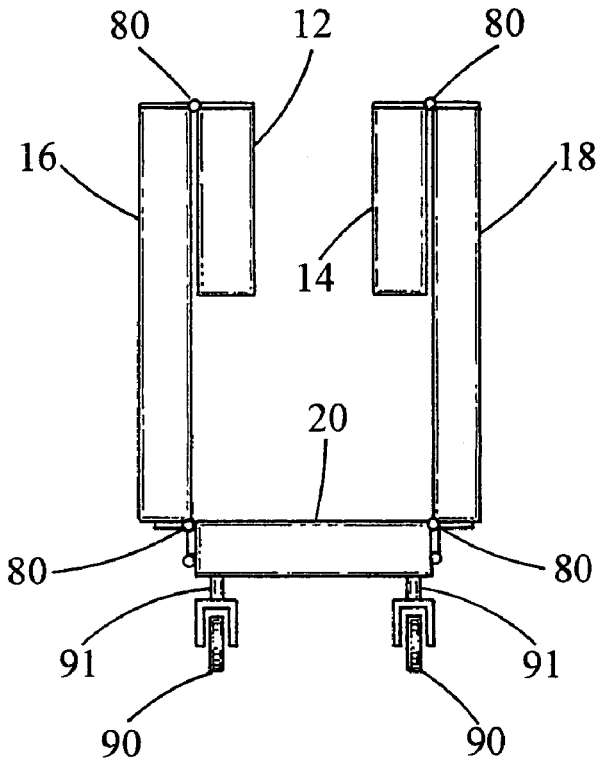
FIG. 3 is a front view of the assembly which is shown in FIGS. 1 and 2 in a folded portable position.

Referring now to FIGS. 1–3, there is shown a portable sports assembly 10 which is made in accordance with the teachings of the preferred embodiment of the invention. As shown, the sports assembly 10 includes a front side 11 having a left side ricochet panel 12, a left side strike panel 16, a right side ricochet panel 14, a right side strike panel 18, and a center panel 20. Particularly, the left side strike panel 16 is movably coupled to both the left side ricochet panel 12 and the center panel 20 by use of hinges 80. The right side strike panel 18 is movably coupled to both the right side ricochet panel 14 and the center panel 20 by use of hinges 80. It should be appreciated that hinges 80 are substantially identical to each other and are substantially low-profile, thereby movably coupling the respective panels 12, 14, 16, 18, 20 in a substantially "hidden" manner. That is, the space between each respective and movably coupled panel 12, 14, 16, 18, 20 is substantially narrow, thereby "disguising" or "hiding" each respective hinge 80. It should be understood that each respective hinge 80 further allows each respective panel 12, 14, 16, 18, 20 to move respective to the panel(s) 12, 14, 16, 18, 20 to which it is coupled in approximately one hundred and eighty degrees, as will be discussed in greater detail below.

The left side ricochet panel 12 has a width 13 which, in one non-limiting embodiment, is approximately twenty inches to two feet wide. The right side ricochet panel 14 has a width 15 which, in one non-limiting embodiment, is substantially identical to the width 13 of the left side ricochet panel 12. The left side strike panel 16 has a width 17 which, in one non-limiting embodiment, is approximately three feet to four feet wide. The right side strike panel 18 has a width 19 which, in one non-limiting embodiment, is substantially identical to the width 17 of the strike panel 16. The center panel 20 has a width 21 which, in one non-limiting embodiment, is approximately six inches to ten inches wide. Each of the aforementioned panels 12, 14, 16, 18, 20 have a height 23, as best shown in FIG. 2 which, in one non-limiting embodiment of the invention, is approximately six and one-half feet to seven and one-half feet. It should be understood that the foregoing approximations of width and height of each respective panel 12, 14, 16, 18, 20 are not limited to the measurements discussed above. Rather, as should be appreciated, the measurements of each respective panel 12, 14, 16, 18, 20 may be reduced or enlarged to substantially any desired measurements. For example and without limitation, each respective panel 12, 14, 16, 18, 20 may be reduced in size to accommodate children or to fit within a relatively small area.

Each of the aforementioned panels 12, 14, 16, 18, 20 may be constructed from substantially any desired material, however, in the preferred embodiment of the invention, each respective panel 12, 14, 16, 18, 20 is constructed from a substantially light-weight and durable material, such as wood or plastic. In one non-limiting embodiment, the panels 12, 14, 16, 18, 20 are constructed from a plastic material having interior support or reinforcement (not shown), such as conventional ribbing, honeycombing, or substantially any desired conventional or commercially available interior support or reinforcing. In yet another non-limiting embodiment, each panel 12, 14, 16, 18, 20 may be constructed from fiberglass, thereby allowing the assembly 10 to be both durable and substantially light-weight.

The sports assembly 10 further includes a left side safety net 40 which, in one non-limiting embodiment, is supported by and coupled to a pair of substantially identical safety net support poles 42. The pair of substantially identical support poles 42 are spaced apart approximately four to six feet and coupled to the profile edge 41 of the left side ricochet panel 12. In one non-limiting embodiment of the invention, the safety net support poles 42 are movably coupled to the left side ricochet panel. For example and without limitation, each of the support poles 42 may be coupled to a hinge, a ball and socket joint, or a pin and collar joint, which in turn is either fixedly or removably coupled to the profile edge 41 of the left side ricochet panel 12.

In yet another non-limiting embodiment of the present invention, the profile edge 41 of the left side ricochet panel 12 may include two substantially identical support pole reception apertures or channels 44, 46. The reception apertures or channels 44, 46 are spaced apart approximately four to six feet and are adapted to frictionally receive and slidably engage approximately three quarters to seven eights of the length of the support poles 42.

The sports assembly 10 further includes a right side safety net 48 which, in one non-limiting embodiment, is supported by and coupled to a pair of substantially identical safety net support poles 50. The pair of substantially identical support poles 50 are spaced apart approximately four to six feet and coupled to the profile edge 51 of the right side ricochet panel 14. In one non-limiting embodiment of the invention, the safety net support poles 50 are movably coupled to the profile edge 51 of the right side ricochet panel 16. For example and without limitation, each of the support poles 50 may be coupled to a hinge, a ball and socket joint, or a pin and collar joint, which in turn is either fixedly or removably coupled to the profile edge 151 of the right side ricochet panel 14.

In yet another non-limiting embodiment of the present invention, the profile edge 51 of the right side ricochet panel 14 may include two substantially identical support pole reception apertures or channels 52, 54. The reception apertures or channels 52, 54 are spaced apart approximately four to six feet and are adapted to frictionally receive and slidably engage approximately three quarters to seven eights of the length of the support poles 50.

As can best be seen in FIG. 2, the back side 69 of the sports assembly 10 includes a plurality of fixedly coupled guide brackets 70 which frictionally and slidably receive a plurality of safety net support poles 58, 60, 62, 64, 66, 68. Particularly, each of the plurality of safety net support poles 58, 60; 62, 64, 66, 68 hold and support a top side safety net 56 which, in one non-limiting embodiment of the present invention, is approximately two feet in height. More particularly, each support pole 58, 60, 62, 64, 66, 68 is received by a respective pair of the guide brackets 70 and contained between the guide brackets 70 and a respective one of the panels 12, 14, 16, 18. In this manner, the support poles 58, 60, 62, 64, 66, 68 may be selectively extended to project vertically (i.e., the safety net 56, while in the vertically extended position, is effective to block a ball that is hit, thrown, or otherwise struck at a trajectory which will carry the ball above the top profile edge 57 of the sports assembly 10) above the top profile edge 57 or be lowered to be substantially flush or level with the top profile edge of the sports assembly 10 (i.e., in the lowered position, the safety net 56 is in a non-operative position which does not project above the top profile edge 57 of the sports assembly 10).

It should be appreciated that each of the abovementioned safety nets 40, 48, 56 may be constructed in whole or in part from a substantially durable and elastomeric material, effective to allow each safety net 40, 48, 56 to expand and contract in order to be stored, in order to be positioned at different angles, and or the like, as will be discussed further below.

In one non limiting embodiment of the present invention, the sports assembly 10 may be equipped to represent a portion of a conventional tennis court. That is, the sports assembly 10 may further include a first net tensioning/support post 32 which is coupled to the profile edge 51 of the right side ricochet panel 14 by use of a guide bracket 36. Moreover, the profile edge 41 of the left side ricochet panel 12 may also include a second net tensioning/support post 34 which is coupled to the profile edge 41 of the left side ricochet panel 12 by use of a guide bracket 38. A substantially narrow net/tape 30 may be movably coupled to the first and the second tensioning/support posts 32, 34.

Furthermore, the respectively coupled panels 12, 14, 16, 18, 20 may also include several tennis court lines 75, 76, 77, 78. That is, the left side ricochet panel 12 and the right side ricochet panel 14 may each include a side line 76 which is in close proximity to a respective profile edge 41, 51 and runs in the direction of the arrow 23, and which represents the side lines or the "singles lines" of a conventional tennis court. The respectively coupled panels 12, 14, 16, 18, 20 may also include a service base line 75 which runs in a direction perpendicular to that of the arrow 23, and is disposed upon the top of each respective panel 12, 14, 16, 18, 20 in close proximity to the top profile edge 57 of each respective panel 12, 14, 16, 18, 20. The respectively coupled panels 12, 14, 16, 18, 20 may further include a net line 78 which traverses across the entire assembly 10 and which is substantially parallel to the arrows 13, 15, 17, 19, 21 and disposed substantially near the center of the assembly. Finally, the respectively coupled panels 12, 14, 16, 18, 20 may also include a middle service line 77 which is disposed within the center of the panel 20 and which runs perpendicular to the arrows 13, 15, 17, 19, 21, thereby dividing the assembly 10 or the center panel 20 in half.

It should be appreciated that the aforementioned tennis lines substantially recreate several portions of a conventional tennis court. That is, the lines 75, 76, 77, 78 form the area 22 which represents a conventional left side service box, the lines 76, 77, 78 form the area 24 which represents a conventional left side forecourt, the lines 75, 76, 77, 78 form the area 26 which represents a conventional right side service box, and the lines 76, 77, 78 form the area 24 which represents a conventional right side forecourt.

In one non-limiting embodiment of the invention, the assembly 10 may further include a right side support rod 32 which is adjustably coupled to a right side support bracket 36, a left side support rod 34 which is adjustably coupled to a left side support bracket 38, and a substantially narrow net or tape section 30 which is coupled to each of the support rods 32, 34, and which traverses the entire assembly 10 in close proximity to the net line 78. It should be understood that the net 30 represents a conventional tennis court net, which divides the tennis court into two substantially equal halves (i.e., the net 30 represents a conventional net of a conventional tennis court that a tennis player must hit the tennis ball over).

It should be appreciated that the combination of the lines 75, 76, 77, 78 and the net 30 allow an individual to serve, hit, volley, and the like a conventional tennis ball while having specific and accurate lines of demarcation to avoid and/or target. For example and without limitation, an individual may desire to practice his/her left service box 22 service techniques and, in a manner which is described in detail below, the individual can stand to the right side of the assembly 10 at a certain distance away from the assembly 10 and attempt to hit the tennis ball into the area 22 while concomitantly avoiding contact of the tennis ball with the net 30, thereby realistically practicing service techniques.

The center panel 20, in one non-limiting embodiment may include two substantially identical pairs of fastening apertures 72, 74, which allow an individual to selectively wrap a belt, rope, tape, or substantially any other fastening device (not shown) around an object (not shown), such as and without limitation, a tree or a lamp post, thereby supporting the assembly 10 while the assembly 10 is in a substantially vertical or generally angled position.

Referring now to FIGS. 2 and 3, the center panel 20, in yet another non-limiting embodiment may include a plurality of blind apertures 92, which are geometrically configured to frictionally receive and removably contain a respective one of conventional caster housings/pins 91 or wheels 90. As best seen in FIG. 3, these blind apertures 72, 74, the casters/wheels 90, and the pins 91 allow the sports assembly 10 to easily maneuver or traverse upon a surface while the assembly 10 is in a stored or folded position, effective to allow the assembly 10 to be selectively portable.

Referring now to FIG. 3, there is shown a compacted or folded sports assembly 10. Particularly, as should be appreciated, each of the respective hinges 80 allow each respective panel 12, 14, 16, 18, 20 to fold or move to a position which allows the assembly 10 to be selectively portable. In one non-limiting embodiment, all of the various components (e.g., safety nets 40, 48, 56, net 30, or the like may be selectively removed from the assembly 10 and stored within the cavity 95 created by each respective and folded panel 12, 14, 16, 18, 20.

Figure 4:
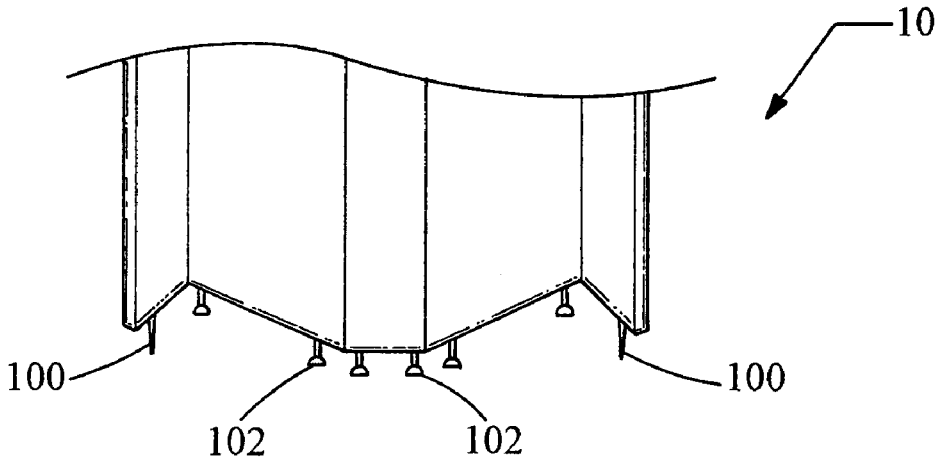
FIG. 4 is a partial perspective and cut away view of the portable sports assembly which is shown in FIGS. 1, 2, and 3.

Referring now to FIG. 4, there is shown the portable sports assembly 10 in an assembled relationship with a plurality of anti-sliding devices 100, 102. That is, in one non-limiting embodiment, the anti-sliding devices 102 are selectively adjustable rubber stoppers which are designed to frictionally engage a substantially flat and relatively smooth surface, such as concrete, thereby substantially prohibiting the assembly 10 from sliding upon a surface or shifting the position of the assembly 10 relative to the surface. In yet another non-limiting embodiment, the anti-sliding devices 100 may comprise selectively adjustable metal spikes. In this manner, the assembly 10 may be utilized (i.e., set up and stabilized by use of the metal spikes 100) upon a "natural surface" (i.e., the term "natural surface" hereinafter refers to a surface which was not created by man, such as dirt, clay, or grass), such as an open field or back yard of a home. It should be appreciated that there are many methodologies for providing selective adjustability of anti-sliding devices, such as and without limitation, threaded posts in combination with threaded apertures. Therefore, the present invention is not limited to any particular methodology for providing selective adjustability. Rather, the present invention may employ or utilize any known methodology for providing the selective adjustability of the devices 100, 102.

Figure 5:
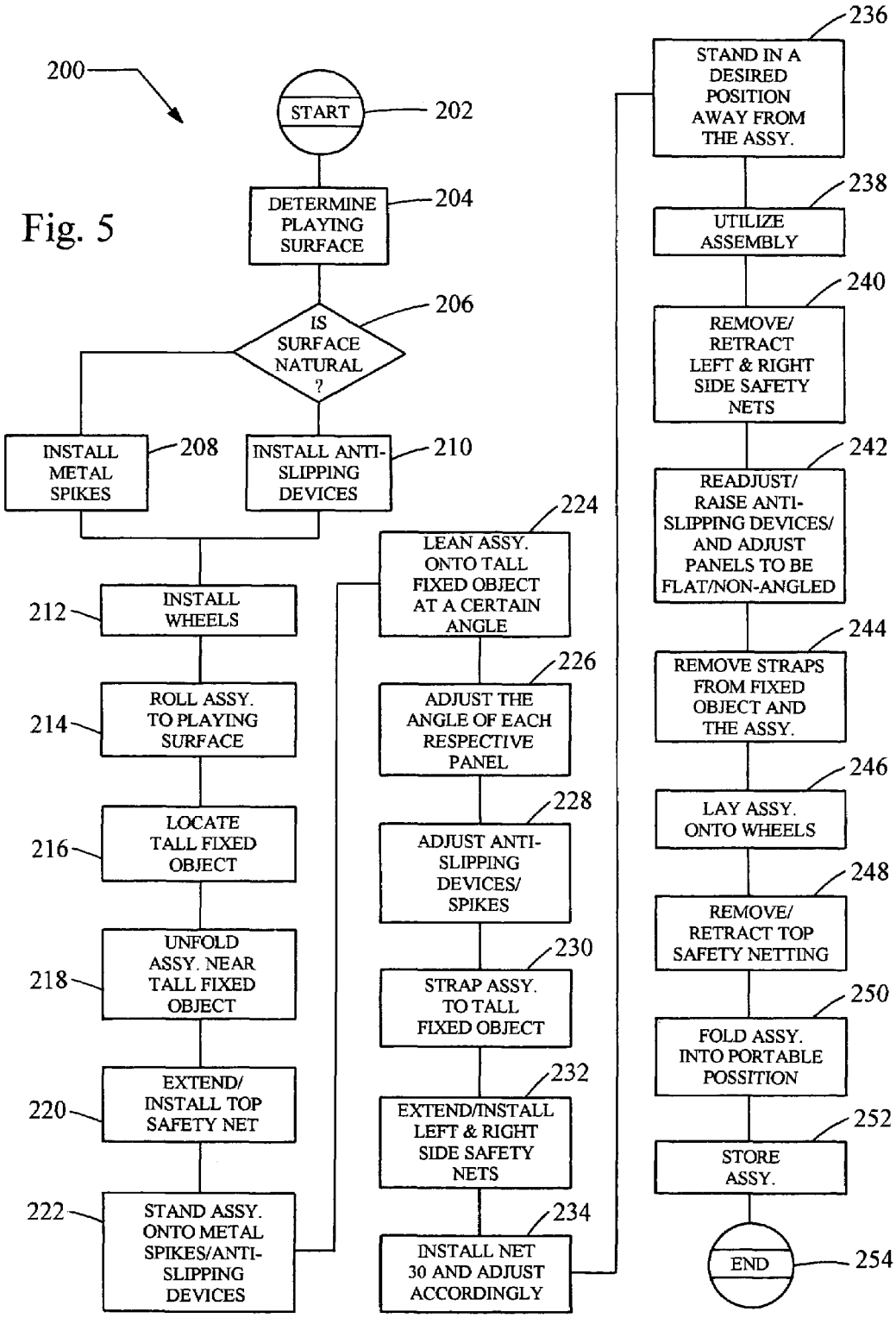
FIG. 5 is a flow chart depicting a methodology and functionality which is performed in accordance with the teachings of the preferred embodiment of the invention.

Referring now to FIG. 5, there is shown a functionality and methodology flow chart 200, which is performed in accordance with the teachings of the preferred embodiment. As shown, the flow chart of the methodology and functionality 200 begins with the step 202 and, in this step 202, the methodology 200 has started. Step 204 follows step 202 and, in this step 204, a user of the methodology 200 (i.e., the user of the methodology 200 hereinafter is sometimes referred to as "the user") determines a surface upon which he/she will "set up" the portable sports assembly 10 (i.e., the term "set up" hereinafter refers to the unfolding, assembling, and securing or stabilizing of the portable sports assembly 10). Step 206 follows step 204 and, in this step 206, the user determines if the playing surface is a natural surface. If the user determines that the selected playing surface is a natural surface, step 208 follows step 206 and, in this step 208, the user installs the metal spikes 100 upon the assembly 10.

If the user determines that the selected playing, surface is not a natural surface, then step 210 follows step 206 and, in this step 210, the user installs the anti-slipping devices 102 (e.g., selectively adjustable rubber stoppers) upon the assembly 10. Step 212 follows the steps 208, 210 and, in this step 212 the user installs the wheels/casters 90 upon the assembly 10 by inserting the pins 91 into a respective one of the blind apertures 92 of the center panel 20.

Step 214 follows step 212 and, in this step 214, the user will push the assembly 10 (i.e., while in a folded position) to the user determined playing surface from step 204. It should be appreciated that the wheels/casters 90 allow the assembly 10 to easily traverse substantially any desired surface in a manner which requires minimal effort by the user.

Step 216 follows step 214 and, in this step 216, the user will locate a substantially tall fixed object (e.g., a tree, lamp post, and the like) upon the user determined playing field. It should be appreciated that, if no substantially tall fixed object can be located by the user, the user may desire to determine a different location (i.e., a different playing field). Step 218 follows step 216 and, in this step 218, the user will roll the assembly 10 in close proximity to the located substantially tall fixed object and unfold the assembly 10 (i.e., the user will change or "transform" the assembly 10 from the form which is shown in FIG. 3 to a form which is substantially similar to the form of the assembly 10 which is shown in FIGS. 1 and 2).

Step 220 follows step 218 and, in this step 220, the user will extend the top safety net 56 by grasping each respective support post 58, 60, 62, 64, 66, 68 and gently pulling until each respective support post 58, 60, 62, 64, 66, 68 abuts a respective one of the "lowest guide brackets" 70 (i.e., the term "lowest guide bracket" hereinafter refers to the guide brackets 70 which are furthest away from the top safety net 56), thereby fully exposing the top safety net above the top profile edge 57 of the portable sports assembly 10. Step 222 follows step 220 and, in this step 222, the user will elevate the top of the assembly 10 (i.e., the top profile edge 57 of the assembly 10) off of the playing surface which was determined within step 204 and stood on either the metal spikes 100 or the anti-slipping devices 102.

Step 224 follows step 222 and, in this step 224, the user will lean the assembly 10 onto the substantially tall and fixed object (i.e., at a certain predetermined or desired angle, such as and without limitation, approximately two and one-half to fifteen degrees) which was located within step 216, such that the two substantially identical pairs of support apertures 72, 74 are in close proximity to the substantially tall and fixed object (i.e., at least a portion of the back side 69 of the center panel 20 is contacting the substantially tall and fixed object). Step 226 follows step 224 and, in this step 226, the user selectively adjusts the angle of each respective panel 12, 14, 16, 18, 20 to be a desired angle. That is, the angle of each respective panel may be determined by measuring the distance away from the assembly 10 that the user desires to stand. In one non-limiting embodiment of the present invention, a measurement table may be included within or imprinted upon a portion of the assembly 10. This measurement table (not shown) may begin with the measurement of ten feet and end with the measurement of thirty or fourty feet. For example and without limitation, a measurement of twenty feet (i.e., the individual desires to stand twenty feet away from the assembly 10) may inform the user that the left side ricochet panel 12 should be at approximately a one hundred degree angle to the left side strike panel 16. Similarly, the measurement of twenty feet may inform the user that: the right side ricochet panel 14 should be at approximately a one hundred degree angle to the right side strike panel 18; the right side strike panel should be at approximately a two hundred degree angle to the center panel 20; and the left side strike panel 16 should be at approximately a two hundred degree angle to the center panel 20.

It should be appreciated that these measurements are merely illustrative and nothing within this description is meant to or should be construed as limiting the angular measurements and the distance measurements to the above-listed measurements. Rather, as should be understood, the angular measurements and the distance measurements may be substantially any desired measurement.

Step 228 follows step 226 and, in this step 228, the user will adjust the selectively adjustable anti-slipping devices 102 or the metal spikes 100 to ensure that the assembly 10 will not lose the desired position relative to the playing surface and the substantially tall and fixed object. Step 230 follows step 228 and, in this step 230, the user will strap the assembly 10 to the substantially tall and fixed object by wrapping a rope or strap (not shown) around the substantially tall and fixed object and then lacing one end of the rope or strap in through a respective one of the pair of substantially identical fastening apertures 72 or 74 and out the remaining respective fastening aperture 70, 72. The rope or strap may then be tied or otherwise fastened, thereby ensuring that the assembly 10 will not undesirably or unintentionally fall down flat upon the playing surface.

Step 232 follows step 230 and, in this step 232, the user will extend/install the left side safety net 40 by grasping the pair of left side safety net support poles 42 and gently pulling until the left side safety net is fully extended (i.e., until the left side safety net 40 has completely cleared the left side profile edge 41). The user will also repeat this step 232 for the right side safety net 48. That is, in this step 232 the user will also grasp the right side safety net support poles 50 and gently pull until the right side safety net 48 has completely cleared the right side profile edge 51. It should be understood that the user may also simply install the left and right side safety nets 40, 48 by placing a portion of the respective support posts 42, 50 into the respective channels 44, 46, 52, 54.

Step 234 follows step 232 and, in this step 234, the user will install/attach the net 30 to the first and the second tensioning/support posts 32, 34. At this time, the user may also selectively raise/lower/swivel the first and the second tensioning/support posts 32, 34 in order to adjust the tension and the height of the net 30. Step 236 follows step 234 and, in this step 236 the user will stand in a desired position a certain distance away from the assembly 10. That is, in this step 236, the user will stand a distance away from the assembly 10 which is optimal for the adjusted angles of the respective panels 12, 14, 16, 18, 20 (i.e., the angles of the panels 12, 14, 16, 18, 20 which were adjusted within the step 226). Step 238 follows step 236 and, in this step 238 the user will utilize the assembly 10 (i.e., the user will throw, hit, kick, or otherwise propel a sports ball at the assembly 10 and the assembly 10 will ricochet the sports ball back to the user).

Step 240 follows step 238 and, in this step 240, the user has finished utilizing the assembly 10 and proceeds to remove/retract the left side and right side safety nets 40, 48 by gently pushing the safety net support posts 42, 50 back into the assembly 10. It should be understood that the user may also simply remove the left and right side safety nets 40, 48 by pulling the support posts 42, 50 from the respective channels 44, 46, 52, 54. Furthermore, within this step 240, the user may also remove the net 30 from the first and the second tensioning/support posts 32, 34.

Step 242 follows step 240 and, in this step 242, the user will readjust/raise the anti-slipping devices 102 or the metal spikes 100 and adjust the panels 12, 14, 16, 18, 20 to be substantially flat or non-angled to any other respective panel 12, 14, 16, 18, 20. Step 244 follows step 242 and, in this step 244, the user will remove/unfasten the straps/rope from the substantially tall fixed object and from the fastening apertures 72, 74, thereby unfastening the assembly 10 from the substantially tall fixed object. Step 246 follows step 244 and, in this step 246, the user will adjust the assembly 10 to clear the substantially tall fixed object (i.e., place the assembly 10 in a position that will not contact the tall fixed object) and lower the assembly 10 onto the wheels 90 by grasping the top profile edge 57 and lowering the top profile edge 57 (i.e., as well as the rest of the assembly 10) until each respective wheel 90 contacts the playing surface and all of the weight of the assembly 10 is supported by the wheels 90.

Step 248 follows step 246 and, in this step 248, the user will retract the top safety net 56 by gently pushing each respective support post 58, 60, 62, 64, 66, 68 until each respective support post 58, 60, 62, 64, 66, 68 abuts a respective one of the "highest guide brackets" 70 (i.e., the term "highest guide bracket" hereinafter refers to the guide brackets 70 which are closest to the top safety net 56), thereby fully hiding or storing the top safety net below or even with the top profile edge 57 of the portable sports assembly 10.

Step 250 follows step 248 and, in this step 250, the user will fold the portable sports assembly 10 back into the portable position (i.e., the position of the sports assembly 10 which is shown within FIG. 3) in a conventional manner. Step 252 follows step 250 and, in this step 252, the user will roll the portable sports assembly 10 back to a desired location and store the portable sports assembly 10. Step 254 follows step 252 and, in this step 254, the methodology and functionality 200 has ended.

It should be understood that this invention is not limited to the exact construction or embodiments listed and described, but that various changes may be made without departing from the spirit and scope of the invention. For example and without limitation, the assembly 10 may have a representation or markings upon the front side 11 which is/are indicative of a first particular sport while the back side 69 of the sports assembly 10 may also have a representation or markings of a second particular sport, thereby providing a portable sports assembly 10 having multiple sporting applications (e.g., the first and second particular sport may comprise baseball, hockey, golf, racquetball, football, basketball, lacrosse, handball, and/or the like). In further example and without limitation, the sports assembly 10 may include a waterproof cover (not shown) which covers the entire assembly 10 while in a folded or stored position.

What is claimed is:

1. A method for using a portable sports assembly, said method comprising the step of:

providing a left side ricochet panel having a first width, a first profile edge, and a second profile edge;

providing a right side ricochet panel having a second width, a third profile edge, and a fourth profile edge;

providing a left side strike panel having a third width, a fifth profile edge, and a sixth profile edge;

providing a right side strike panel having a fourth width, a seventh profile edge, and an eighth profile edge; and providing a center panel having a fifth width, a ninth profile edge, and a tenth profile edge;

pivotally coupling said second profile edge of said left side ricochet panel to said fifth profile edge of said left side strike panel;

pivotally coupling said sixth profile edge of said left side strike panel to said ninth profile edge of said center panel;

pivotally coupling said tenth profile edge of said center panel to said seventh profile edge of said right side strike panel;

pivotally coupling said eighth profile edge of said right side strike panel to said third profile edge of said right side strike panel;

providing a measurement chart having predetermined measurements of length and angles;

selectively adjusting as angle between each of said panels according to said predetermined measurement so said provided measurement chart; and propelling a ball at said respective panels, effective to cause said ball to strike said respective panels and ricochet back to an individual.

* * * * *